US010486073B1

(12) United States Patent
Weiner

(10) Patent No.: US 10,486,073 B1
(45) Date of Patent: Nov. 26, 2019

(54) RADIAL THEME PARK

(71) Applicant: Robert S. Weiner, Atlanta, GA (US)

(72) Inventor: Robert S. Weiner, Atlanta, GA (US)

( * ) Notice: Subject to any disclaimer, the term of this patent is extended or adjusted under 35 U.S.C. 154(b) by 3 days.

(21) Appl. No.: 15/904,907

(22) Filed: Feb. 26, 2018

Related U.S. Application Data

(60) Provisional application No. 62/500,687, filed on May 3, 2017.

(51) Int. Cl.

| | |
|---|---|
| ***A63G 31/00*** | (2006.01) |
| ***E01D 18/00*** | (2006.01) |
| ***E01C 1/00*** | (2006.01) |
| ***E04H 3/10*** | (2006.01) |

(52) U.S. Cl.
CPC ..... *A63G 31/00* (2013.01); *E01C 1/002* (2013.01); *E01D 18/00* (2013.01); *E04H 3/10* (2013.01)

(58) Field of Classification Search
CPC ..... A63G 1/00; A63G 17/00; A63G 31/00; A63G 31/16; A63G 2031/00; A63G 2031/002; A63G 2031/005; E01D 18/00
USPC ..... 472/28–30, 32–33, 57, 59–60, 136, 137
See application file for complete search history.

(56) References Cited

U.S. PATENT DOCUMENTS

| | | | | |
|---|---|---|---|---|
| 2,912,244 | A * | 11/1959 | Carr | A63G 31/16 472/40 |
| 3,643,941 | A * | 2/1972 | Kashar | A61M 21/0094 273/DIG. 2 |
| 4,457,509 | A * | 7/1984 | St-Germain | A63G 31/00 434/258 |
| 6,328,658 | B1 * | 12/2001 | Gnezdilov | A63G 27/00 472/136 |
| 6,805,558 | B1 * | 10/2004 | Carl | A63G 31/00 434/258 |
| 2015/0065260 | A1 * | 3/2015 | Beyr | A63G 31/16 472/60 |

* cited by examiner

*Primary Examiner* — Kien T Nguyen
(74) *Attorney, Agent, or Firm* — Steven J. Stark; Miller & Martin PLLC

(57) ABSTRACT

A radially oriented theme park attempts to minimize distances between attractions for many embodiments while providing a central ingress/egress location through a hub which is preferably accessed by a limited access path from outside an outer perimeter of the park.

19 Claims, 2 Drawing Sheets

RADIAL THEME PARK

CLAIM OF PRIORITY

This application claims the benefit of U.S. Provisional Application No. 62/500,687 filed May 3, 2017, which is incorporated herein by reference in its entirety.

FIELD OF THE INVENTION

The present invention relates to theme parks and more particularly to a radially oriented theme park having a central hub, preferably in the form of a building, possibly with multiple stories, with radially outwardly oriented attractions accessible from the hub such as across a patio or otherwise.

BACKGROUND OF THE INVENTION

Amusement parks have been around for decades. While many are organized in many different ways, none are known to be designed to have all entrances to rides within a certain predetermined length of one another as well as within a particular distance of a hub in a radial manner. Accordingly, most amusement parks require users to walk long distances from one point to another to access certain rides as well as take up a large amount of land.

Accordingly, a more compact design for an amusement park is believed to be desirable in the marketplace while potentially simultaneously reducing the number of employees to operate the park.

SUMMARY OF THE INVENTION

It is an object of many embodiments of the present invention to provide an improved amusement park and/or design.

As another object of many embodiments of the present invention to provide a radially oriented configuration whereby a central hub is provided from which rides entrances can be oriented radially therefrom for at least a majority of the rides and then parking be located radially externally from at least a portion of the rides, possibly in conjunction with underground directed tram(s) or walkway (s) to the hub for entrance and exit from the park at a central location so as to potentially minimize the number of entrance and exit gates.

Accordingly, in accordance with the presently preferred embodiment of the present invention, a radially oriented theme park can be provided. A central building or buildings can be preferably provided at a hub. Externally disposed relative to the hub may be a walkway, boardwalk or patio from at least one level if not multiple levels extending from the patio ride entrances can be accessed radially exteriorly therefrom. In addition to ride entrances, other attractions may be accessed in a similar manner as well. Some attractions may be accessed above or even below grand level.

Radially externally relative to the ride entrances and/or rides, may be the parking for the amusement park. In order to access the amusement park from the parking, it is anticipated that trams or walkways will take the visitors to an entrance possibly at the hub.

One possibility for many embodiments may be to have the entrance/exit under or at the hub whereby trams can take the users possibly underground to the entrance/exit. Such a construction can place vehicles relatively close the entrance/exit so as to minimize the amount of fuel and/or energy utilized by the trams to transport the visitors. Walkways through relatively short tunnels could also be a possibility.

The building or buildings in the hub may be multiple levels and possibly be provided with attractions in and of themselves whether they be arcade and/or carnival games located on the various levels, monitors whether they be related to sporting events, betting or even possibly allowing the ability to virtually stand in line at one or more of the specific attraction entrances, so that the users can effectively save their space in line and then leave from the hub to the entrance at a desired interval to effectively minimize, if not eliminate, a wait in line at the particular attraction entrance located radially externally to the hub.

The presently preferred embodiment has roughly a 200 foot diameter about the hub which could be as high as ten to fifteen more stories high. Games and other restaurants, TV's showing sporting activities, para-mutual betting, if legal at the location could also be provided at various levels. Access to certain levels could be restricted based on age or other parameters.

A walkway or patio external to the hub could be 100 to 200 feet or more in width. On or near the periphery of the patio could be the entrances to the rides which could then possibly extend radially therefrom. Roller coasters could be designed to take advantage of this spacing by having a relatively narrow footprint directed towards the hub and/or patio with it possibly expanding radially outwardly or at least partially radially thereof and/or going over or beside other attractions. Additionally, radial staggering could occur with one entrance occurring at the end of a patio while another could have an access from the walkway through a passage and/or alternatively be a distance radially away from many of the attraction entrances so as to provide an ability to grow the park radially externally from the hub over time. While this may not be preferred for all embodiments as it would extend the walking distance to specific attractions, it would allow for the ability for the park to grow. Another alternative would be to have multiple hubs be provided, possibly with access by trams or otherwise with another set of radially extending attractions as described above.

Additionally, rides and/or attractions may be able to be staggered elevationally in addition to radially so as to provide for more attractions on a smaller land footprint.

As one can quickly see, the advantages of this style amusement park may provide an ability to construct the amusement park on a significantly smaller piece of land than many prior art amusement parks have been constructed. Additionally, such a design would significantly reduce the distance that one would need to walk from one location to another substantially so that the maximum distance one would need to walk from any one ride to another (not counting the distance one might have to walk around the hub) would be the diameter of a circle between spanning opposite attraction entrances if that was the path that one selected to choose. Much shorter distances could be achieved if one walked from one to adjacent attractions.

Additionally, by having the hub one could simply walk from the exit of one attraction to the hub and then possibly utilize a feature to virtually save one's space in one or more lines to then be able to coordinate when to leave the hub or other location to go back out to the next attraction. All this could be coupled with technology so that one could have data provided on the cell phone or other smart device to have a particularly enjoyable amusement park experience.

By constructing a park in this manner, the physically disabled and others could have a particularly enjoyable amusement park experience without a need to be transported extensively over geographical distances over an amusement park.

Additionally, by having a central hub, different eating options and/or amusement options can be placed about and/or in the hub either on the ground level and/or at various levels above it so as to take advantage of a relatively small site plan on the ground while still providing a plurality of options to the users. Furthermore, by having workers at one location it may be possible to enjoy economies of scale by possibly having multi-tasking workers that could cover different labor needs of the company over time. For instance, it may be that certain floors of the hub could be shut down depending on park attendance and/or other factors. Furthermore, during high volume of eating requirements, it may be possible that some game operators may be directed to the eating floors from games during common meal times and then being directed back to games when the demands on the eating establishments are less. The areas devoted towards the games could be shut down during those high eating volume periods.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
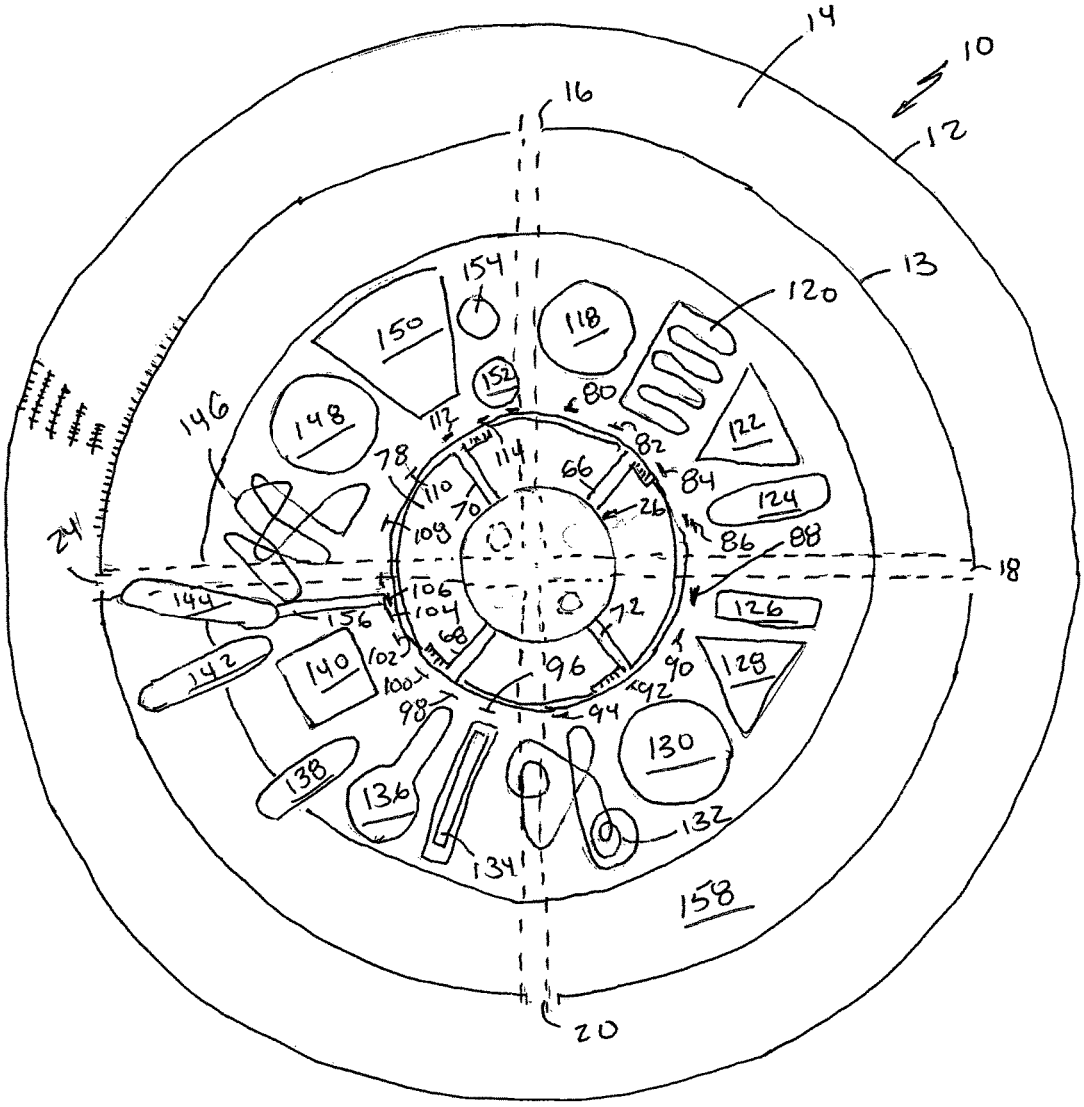
FIG. 1 is a top plan view of the presently preferred embodiment of the present invention.

FIG. 1 shows the presently preferred embodiment of a design of a radially oriented amusement park 10 of a presently preferred embodiment of the present invention. Specifically, the amusement park 10 is constructed in a way to attempt to minimize the footprint shown by a second outer perimeter 12 needed to thereby potentially maximize the efficiency use of land. Although a perfect circle is shown in circumference of the second outer perimeter 12, other perimeters and portions of the park 10 can have other different shapes, which may in part be directed by available land and/or terrain features.

Figure 2:
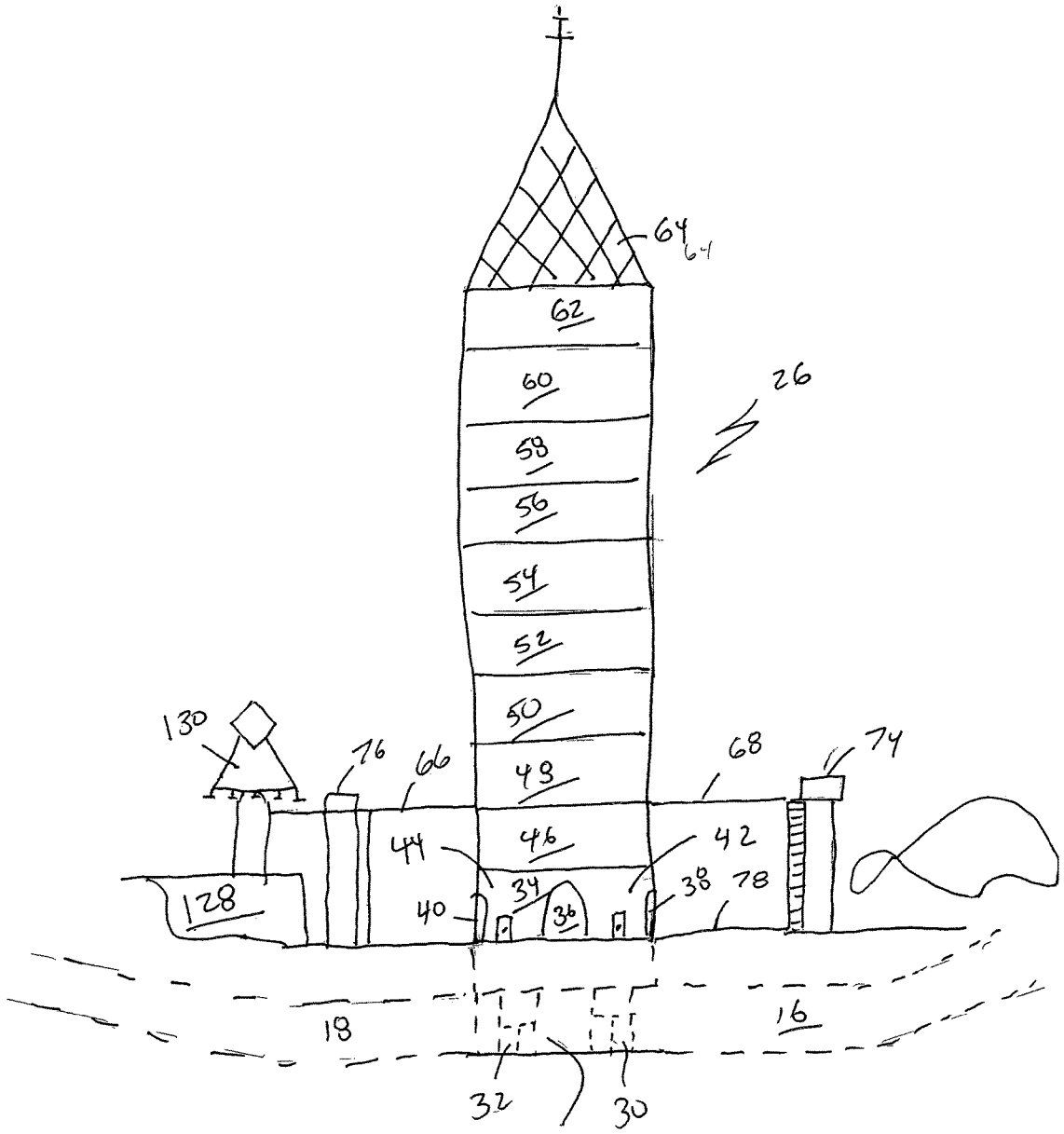
FIG. 2 is a side cross sectional view of a portion of the embodiment show in FIG. 1.

Internal to the second outer perimeter 12 is preferably one or more parking area(s) 14 which will be described in further detail below along with a first outer perimeter 13 which preferably extends about entrances and/or attractions as will be described below. Visitors park in parking 14 may be shuttled by tram and/or walkways 16, 18, 20, 24 (limited access paths) to a central hub 26 which may be constructed similar or dissimilar to the one shown in FIG. 2. Hub 26 may be comprised of one or more buildings. Hub 26 need not be circular as shown for all embodiments and need to not necessarily be at the epicenter of the first perimeter 13 for all embodiments.

Access portions 16, 20 provide access through limited access paths (i.e., outside of first perimeter 13 to ingress/egress gate 28) such as could be provided by at least partially underground or constrained accesses such as tunnels or otherwise into entrance/exit 28 (ingress/egress gate) which may be at ground level, above ground level, or at least partially, if not completely, below level as shown. It may be possible to direct visitors from entrance gate 28 to one more levels of the hub 26 above ground or otherwise such as through ticketing or other locations so as to then have access to the remainder of the park 10. Elevators 30, 32 and/or other access may be provided into other portions of the hub 26. Vehicles or walkways may provide through access portions 16, 20.

Hub 26 is shown having ten above ground levels although certainly other numbers of levels could be provided in various embodiments. Ground level 34 may have accesses 36, 38, 40 and/or others to various directions internal to the park 10. Ground level 34 may also have a variety of retail/restaurant locations such as locations 42, 44 shown at ground level such as gift shops, restaurants, restrooms, snack centers, or even wheelchair or buggy rentals, etc. All of these could also be described as attractions. There are additionally nine other levels illustrated above ground although a different number of levels can be provided above ground level 34 such as second level 46, third level 48, fourth level 50, fifth level 52 up through tenth level 62. An additional structure may be located on the roof 64 for various embodiments, whether that be an aesthetic element such as a decorative tower or a functional element such as a greenhouse for a butterfly garden or other aspect above the upper floor 62 as can be provided with various embodiments.

The various floors 34, 46-62 can provide various uses (i.e., provide attractions) whether they be to host television screens such as for watching sports events and/or paramutual betting (if legal). Game rooms could be provided such as for arcade style games, carnival games as are common in amusement parks, or other games. Additionally, the various floors may have restaurants and/or restrooms either located on specific floors or scattered amongst the floors 34, 46-62. These or other floors 34, 46-62 may have other uses as well. Hub 26 may be comprised of one or more buildings. Some sections of floors or levels 34, 45-62 can be closed during off peak times, or otherwise, to redirect employees of the part to other locations. Visitors to the park may check in at the attractions entrance to then receive a placement position to visitors whereby the visitor can check in to save a place in line w/o requiring a physical presence until a time or other indicia is provided to the visitor. Indicia could include numbers times or other information.

Additionally, access to the ground floor 34 may provide access to other portions of the park 10 in the illustrated embodiment. Additional access, such as from third floor 48 or other floors 46, 50-62 could be provided through elevated walkways 66, 68, 70, 72 or otherwise. The walkways 66-72 are shown being directed to elevated train stations 74, 76 which may provide access to an elevated train about patio 78 which may provide a walkway completely about the hub 26 and/or patio 78 for at least some embodiments. Other attractions may be accessed by walkways 66, 68, 70, 72 above (or below) boardwalk or patio 78. Patio 78 may encircle the hub 26 and provide a band of a width of at least 50, if not 100-200 feet extending radially away from the hub 26.

There certainly may be water features or even kiosks or other things in the patio 78 or elsewhere in the park 10. External to and/or near a periphery of the patio 78 is preferably a plurality of attractions entrances 80-116 which provide corresponding access to respective attractions 118-154 respectively. Various attractions 118-154 could be rollercoasters such as 120, 132, 146. Attractions could be amphitheaters such as 150. Attractions could be buildings such as 126, 128. Attractions could be Ferris wheels such as 134. Attractions could be bumper car tracks such as 118.

Attractions could be racetracks such as 124. Attractions could be water based rides such as a log ride 136 or any number of kind of rides and/or attractions as are provided at amusement parks either now known or developed in the future.

As one will quickly understand from FIG. 1, attractions are preferably radially directed at least somewhat outwardly relative to the hub 26 and preferably as well as to a patio 78. In fact, some of the attractions 118-154 may be staggered relative to the others such as entrance 100 providing access to attraction 138 relative to entrance 98 providing access to attraction 136. A tunnel 156 or other passage may be useful for some attractions, such as above ground or below ground to provide access to some attractions such as 144.

In this way or others, the number of attractions can grow over time such as to encompass portions of outer ring 158 and or additional outer rings 158 (radially beyond outer ring 158) which may be between outer ring 158 and parking 14 and/or interspersed with parking 14.

Furthermore, attractions may intersect radially such as rollercoaster 146 may overlap with a portion of, or radially extended over, adjacent attraction 148. Additionally, there may be elevational stacking such as relative to an attraction such as 126 relative to 130. Not every attraction 118-154 need occur on the ground level. There could additionally be underground attractions 118-154 or partially underground attractions as well.

While traditional amusement parks 10 could have the design as shown, waterparks or those parks 10 having waterparks therein could be incorporated in a similar type design. Hubs 26 might be slightly larger or not for such embodiments so as to be able to include areas to dry off and/or sun oneself. Sunning could also occur all over the patio 78 and/or various portions of the patio 78 or park 10. A train of various kinds and/or the lazy river type structure might be used with or instead of an elevated train.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A radially oriented amusement park comprising:

a central hub disposed centrally relative to a first outer perimeter defined at least substantially by a barrier about said radially oriented amusement park, wherein said central hub is at least substantially surrounded by and spaced from the first outer perimeter and the central hub provides at least one visitor entrance/egress gate for accessing attractions inside the radially oriented amusement park from external to the radially oriented amusement park, said radially oriented amusement park having attraction entrances inside the first outer perimeter and radially external to the central hub, and said central hub accessible by a limited access path providing a passageway from outside the first outer perimeter to the central hub through the radially oriented amusement park.

2. The radially oriented amusement park of claim 1 wherein the limited access path is located, at least partially, underground.

3. The radially oriented amusement park of claim 2 wherein the limited access path provides for at least one of vehicle and walkway traffic underneath portions of the park.

4. The radially oriented amusement park of claim 2 wherein the limited access path is located underground from the hub to the first outer perimeter.

5. The radially oriented amusement park of claim 1 further comprising a patio about the hub extending in a band having a width of at least about 100 feet radially away from the hub and internal to the first outer perimeter and at least some of the attraction entrances are located within and external to the patio.

6. The radially oriented amusement park of claim 5 wherein the patio encircles the hub.

7. The radially oriented amusement park of claim 6 wherein the width of the patio is in a range of at least 100-200 feet.

8. The radially oriented amusement park of claim 5 wherein the attraction entrances are at a radial periphery of the patio.

9. The radially oriented amusement park of claim 8 wherein footprints of first and second adjacent attractions in the park external to the hub overlap.

10. The radially oriented amusement park of claim 8 wherein at least first and second adjacent attraction entrances in the park external to the hub are radially staggered.

11. The radially oriented amusement park of claim 8 wherein third and fourth adjacent attraction entrances in the park external to the hub are elevationally staggered.

12. The radially oriented amusement park of claim 5 further comprising at least one elevated walkway extending radially away from the hub to a ride entrance located within the first outer perimeter.

13. The radially oriented amusement park of claim 1 further comprising a parking lot located radially externally to the first outer perimeter of the park.

14. The radially oriented amusement park of claim 13 wherein the parking lot is located intermediate the first outer perimeter and a second outer perimeter spaced radially outwardly relative to the first outer perimeter.

15. The radially oriented amusement park of claim 1 wherein the entrance/egress gate is located below ground level.

16. The radially oriented amusement park of claim 1 wherein the hub has multiple levels.

17. The radially oriented amusement park of claim 16 having at least three levels with at least some of the following: games, an arcade, monitors, televisions, an attraction, a restaurant, and rest rooms.

18. The radially oriented amusement park of claim 17 wherein a floor is selectively closed at selected times while the park is open.

19. The radially oriented amusement park of claim 18 wherein the floor has a restaurant and when the restaurant is closed with the floor being closed, the personnel are redirected to other positions within the park.

* * * * *